United States Patent [19]

Langner

[11] 4,288,070

[45] * Sep. 8, 1981

[54] CHUTE RETURN MECHANISM FOR A PHOTOCOPIER COLLATOR

[76] Inventor: Fred R. Langner, 48 Hillcrest La., Williamsport, Pa. 17701

[ * ] Notice: The portion of the term of this patent subsequent to May 8, 1998, has been disclaimed.

[21] Appl. No.: 75,135

[22] Filed: Sep. 12, 1979

Related U.S. Application Data

[63] Continuation-in-part of Ser. No. 46,673, Jun. 8, 1979.

[51] Int. Cl.[3] ..... B65H 29/60; B65H 39/11

[52] U.S. Cl. ..... 271/296; 271/302

[58] Field of Search ..... 271/296, 302, 303, 297, 271/298, 287, 292, 208, 311; 270/58; 193/31 R, 31 A; 414/51

[56] References Cited

U.S. PATENT DOCUMENTS 3,315,957 4/1967 Mazzio et al. ..... 271/296

3,578,859 5/1971 Stillings ..... 271/311 X

OTHER PUBLICATIONS

Bothun, M. E. et al., "Card Stacker", *IBM Technical Disclosure Bulletin,* vol. 14, No. 3, Aug. 1971, pp. 827-828.

*Primary Examiner*—Bruce H. Stoner, Jr.

*Attorney, Agent, or Firm*—Birch, Stewart, Kolasch & Birch

[57] ABSTRACT

The present invention is directed to a chute return mechanism for use in combination with a photocopier collator wherein a movable paper chute is disposed between a discharge slot of a photocopy machine and an entry point of a plurality of bins mounted adjacent thereto. The chute return mechanism controls the movement of the movable paper chute so that copies received from the photocopy machine are directed successively into one of the plurality of bins. The chute is successively diverted to each of the predetermined number of bins by means of a pulse from the photocopy machine which indicates that a copy has been produced and discharged to a bin. The pulse actuates a solenoid which controls a cam latch of the chute return mechanism thereby releasing a follower which is attached to the movable paper chute. Actuation of the solenoid successively lowers the paper chute to divert successive sheets of photocopies to each of the predetermined number of bins. After the pulse from the photocopy machine has actuated the solenoid, the latch is pulled away from the solenoid by means of a spring. After a predetermined number of photocopies have been diverted to each of the successive bins, a second solenoid is actuated to impart motion to a lever which returns the follower member connected to the movable paper chute to its original position to repeat the cycle.

10 Claims, 3 Drawing Figures

CHUTE RETURN MECHANISM FOR A PHOTOCOPIER COLLATOR

CROSS-REFERENCE TO RELATED APPLICATIONS

The present application is a continuation-in-part of co-pending application Ser. No. 46,673 filed June 8, 1979, and entitled "PHOTOCOPIER COLLATOR".

BACKGROUND OF THE INVENTION

1. Field of the Invention

The present invention is directed to a chute return mechanism for use in combination with a collator for a modern, electrostatic photocopy machine.

2. Description of the Prior Art

Various collating machines are available in the prior art for separating successive copies of a document into groups. Normally, the collating machines are rather complicated and expensive. For example, the selective tray sheet sorting machine disclosed by Lawrence in U.S. Pat. No. 4,026,540, is directed to a collating machine which is rather bulky and extremely complicated.

Regensteiner, U.S. Pat. No. 615,636, discloses an anti-offsetting apparatus for a printing press. This device is designed to divert printed sheets to one of the trays 32. Again, this device is rather bulky and awkward and does not lend itself to be readily combined with a modern, electrostatic photocopy machine.

Whitehead, U.S. Pat. No. 2,076,391, discloses a sheet segregating apparatus whereby copies from a duplicating machine are diverted to one of several trays. A guide 31 is selectively lowered by one of the cams 28, 29 or 30. Similarly, in a second embodiment, the guide 51 is selectively lowered to divert a copy to one of the trays 52–55 by means of cams, only one cam 67 being shown.

The apparatus disclosed by Whitehead requires a mechanical connection between the duplicating machine and the cam which operates either the guide 31 or the guide 51. Although this mechanical connection is readily adapted for use in combination with a mimeograph duplicating machine, it is not readily adapted for use in combination with a modern, electrostatic photocopy machine.

SUMMARY AND OBJECTS OF THE INVENTION

It is a primary object of the present invention to provide a chute return mechanism for a photocopies collator which is relatively simple in construction.

Another object of the present invention is to provide a chute return mechanism for a photocopier collator including a lever mechanism for positively returning a movable paper chute from a diverted position to its initial position.

A further object of the present invention is to provide a chute return mechanism for a photocopier collator wherein a movable paper chute is selectively lowered to divert a photocopy to each of a plurality of selected bins upon actuation by a first solenoid, electrically connected to a photocopy machine, and is thereafter positively returned to its initial position by means of a second solenoid operatively connected through a lever mechanism.

A still further object of the present invention is to provide a chute return mechanism for a photocopier collator wherein a movable chute is actuated by a first solenoid connected to a cam latch which engages the movable paper chute to selectively lower the chute from an initial position to thereby divert photocopies to successive bins and is positively returned to its initial position, after a predetermined number of photocopies have been diverted by means of a second solenoid operatively connected to a pair of lever arms rotatably mounted about the same pivot point as said movable paper chute.

These and other objects of the present invention are accomplished by providing a chute return mechanism for a photocopier collator wherein a plurality of bins are mounted adjacent to the discharge slot of a photocopy machine. A movable paper chute is designed to receive copies from a discharge slot of the photocopy machine and successively divert them into each of the plurality of bins by means of a cam latch operatively connected to the movable chute and connected to a first solenoid which is electrically connected to the photocopy machine to successively lower the movable chute. After the predetermined number of photocopies have been diverted to each of the successive bins, a second solenoid is actuated to impart motion to a pair of lever arms rotatably mounted about the same pivot point as said movable paper chute to return the chute to its initial position.

Further scope of applicability of the present invention will become apparent from the detailed description given hereinafter. However, it should be understood, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
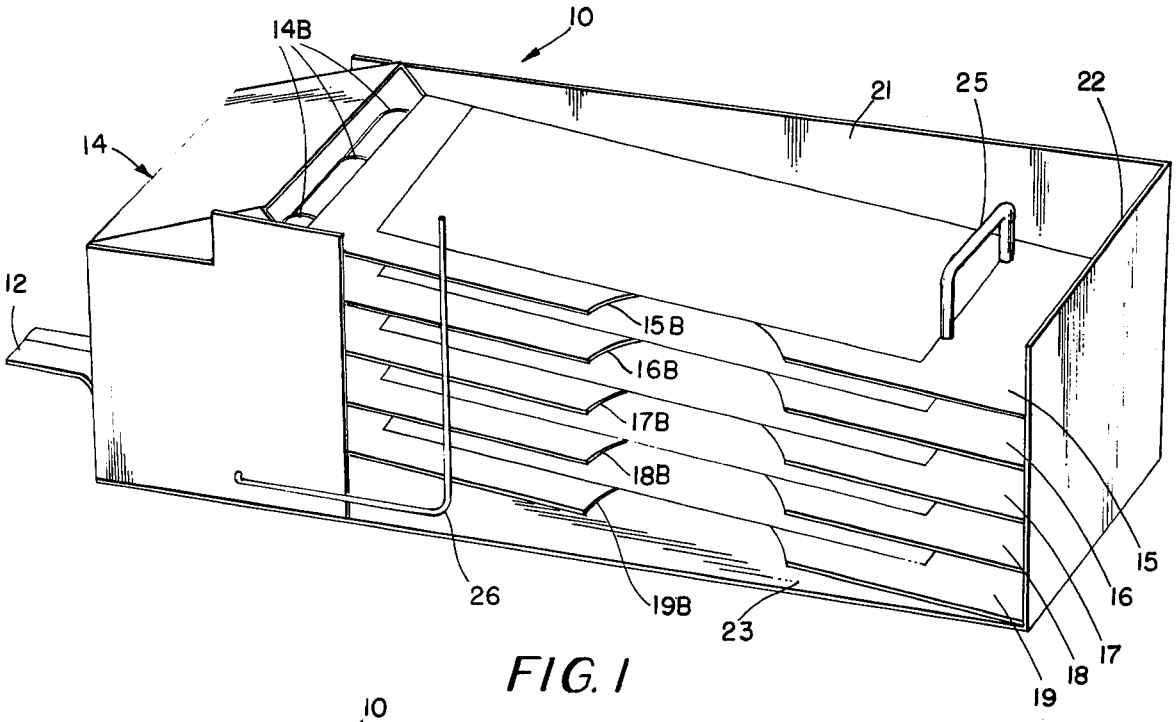
FIG. 1 is a perspective front view illustrating a photocopier collator to which the chute return mechanism according to the present invention is operatively connected.
Figure 2:
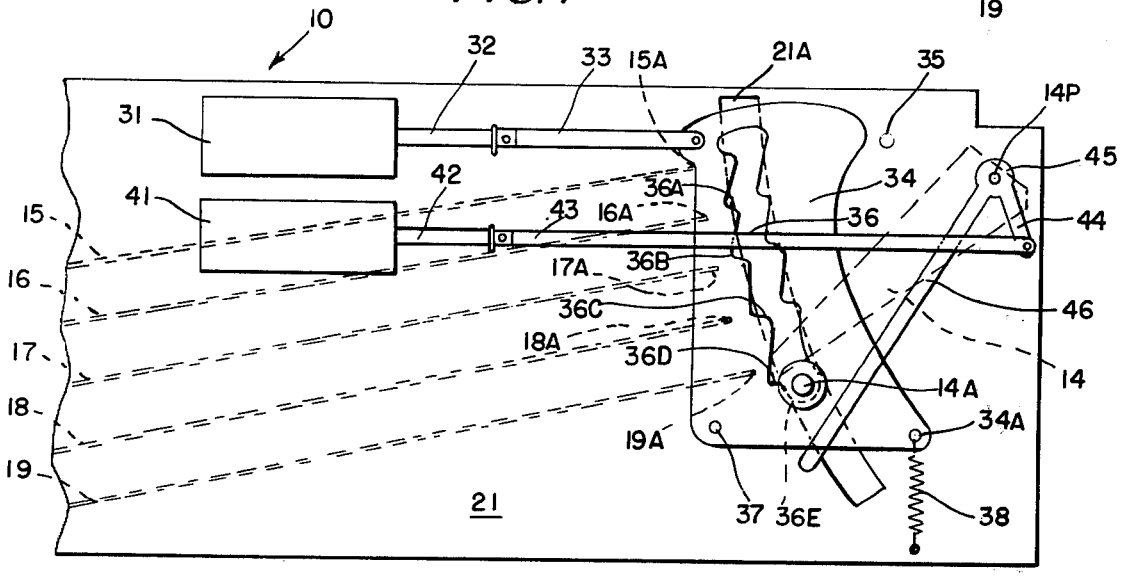
FIG. 2 is a rear view of a photocopier collator illustrating a cam latch operatively connected to a first solenoid and a chute return mechanism operatively connected to a second solenoid.

As illustrated in FIGS. 1 and 2, a photocopier collator is generally indicated by character 10. The collator is readily attached to a modern, electrostatic photocopier machine by means of a pair of flanges 12 which are designed to be adjustable so as to accurately position the receiving end of a movable paper chute 14 directly adjacent to a discharge slot of an electrostatic photocopy machine.

Five bins 15–19 are provided at the discharge side of the movable paper chute 14. Photocopies from the electrostatic photocopy machine are successively diverted by means of the movable paper chute 14 to each of the predetermined number of bins 15–19. The bins 15–19 are positioned within a housing which includes a backwall 21, an endwall 22 and a bottomwall 23. One end and a front side of the housing are opened. The opened end is adapted to be connected to a modern, electrostatic photocopy machine by means of the flanges 12. The front side of the housing provides access to the collated photocopies positioned within the bins 15–19. In addition, semi-circular openings 15B–19B are provided along the open front side to facilitate the removal of photocopies from the bins 15–19.

As illustrated in FIGS. 1 and 2, the bins 15–19 are inclined relative to the bottomwall 23 of the housing. In this manner, photocopies discharged from the electrostatic photocopy machine are readily received and slide under the influence of gravity within the bins.

As illustrated in FIG. 2, positioned on the backwall 21 of the housing is a first solenoid 31. The first solenoid includes an operating arm 32 which is connected by means of a link 33 to a cam latch 34. The cam latch is pivotally mounted about a pivot point 37 on the backwall and its movement is limited by means of a stop 35.

The cam latch 34 includes an opening 36 which defines a tortuous path. A follower 14A attached to the movable paper chute 14 is adapted to be positioned within the opening 36. In addition, the opening 36 includes four flanges 36A–36D which accurately position the follower 14A and the chute 14 to divert a photocopy from the electrostatic photocopy machine to one of the bins 15–19. When the follower 14A is positioned on the flange 36A a photocopy will be diverted to bin 15. Similarly, when the follower 14A is positioned on the flange 36B a photocopy will be diverted to the bin 16. In a similar fashion, the flange 36C corresponds with bin 17 and the flange 36D corresponds with bin 18. The bottom 36E of the opening 36 positions the follower 14A so as to divert a photocopy to the last bin 19.

The cam latch includes an arm 34A connected to a spring 38 for returning the cam latch 34 to its normally substantially vertical position after the solenoid 31 has actuated to move the cam latch 34 to the left, as illustrated in FIG. 2, to lower the follower 14A from one flange surface to the next adjacent flange surface. It is important to note that FIG. 2 is a view of a photocopier collator, to which the chute return mechanism according to the present invention is operatively connected, as viewed from the back of the photocopier collator. Therefore, the modern, electrostatic photocopy machine would be positioned to the right of the photocopy collator as illustrated in FIG. 2.

The backwall 21 of the housing includes an arcuate slot 21A. The arcuate slot 21A together with the opening 36 in the cam latch 34 act as a guide for the follower 14A of th movable chute 14. As illustrated in FIG. 2, the movable paper chute 14 is pivoted about the point 14P. The arcuate slot 21A corresponds to an arc made by follower 14A as the movable paper chute 14 pivots about the point 14P.

As illustrated in FIG. 2, a second solenoid 41 includes an operating arm 42 which is operatively connected to the chute return mechanism according to the present invention. The second solenoid 41 imparts movement to the operating arm 42 which in turn moves a linkage 43 thereby rotating a lever arm 44 about the pivot point 14P. The lever arm 44 is connected at 45 to a second lever arm 46, the lever arms 44 and 46 rotate together about the pivot point 14P.

Figure 3:
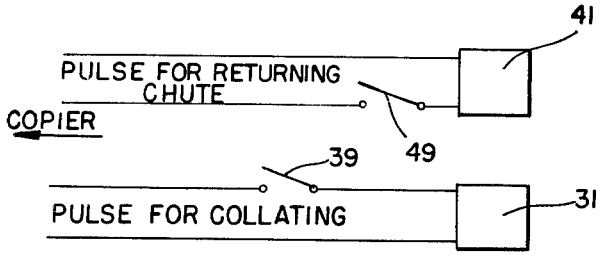
FIG. 3 is a schematic illustration of the electrical connection for controlling the first and second solenoids according to the present invention.

The second solenoid 41, the linkage 43 and the lever arms 44, 46 are provided to return the movable paper chute from the bottom 36E of the opening 36 back to its original, initial position adjacent to bin 15. In this manner, after a predetermined number of photocopies have been diverted to the predetermined number of bins 15–19, the movable paper chute 14 is returned to its initial position to begin diverting a second photocopy for collating together with the first photocopy already deposited in the predetermined number of bins. Actuation of the second solenoid 41 retracts the operating arm 42 thereby rotating the lever arms 44 and 46 clockwise to raise the follower chute 14A and the chute 14 upwardly to the top flange 36A. As set forth above, the photocopier collator is ready to receive and divert a second photocopy to the bin 15 and thereafter the solenoid 31 will be actuated to move the cam latch 34 to the left, as illustrated in FIG. 3, to enable the follower 14A of the movable paper chute to be dropped from the flange 36A to the flange 36B. The spring 38 returns the cam latch 34 to its normally substantially vertical position after the solenoid 31 has been actuated.

As illustrated in FIG. 1, each of the bins 15–19 includes a paper adapter 25 which is positioned adjacent the lower end of the bins. The paper adapted is removable so that larger photocopies may be received within the bins. Therefore, the bins 15–19 may be adjusted to receive photocopies which are 8½" by 11" and photocopies which are 8½" by 14". Similarly, other suitable standard size photocopies may be received within the bins 15–19 by positioning the paper adapter 25 at a suitable predetermined location within mating openings along the bins.

At the entry point of each bin 15–19, deflectors 15A–19A are provided to prevent the photocopy received within the particular bin from being bounced back onto the movable paper chute 14. In addition, the deflectors 15A–19A aid in the stacking of the photocopied received in the bins. However, the deflectors 15A–19A, although preferred, may be deleted from the photocopier collator without detracting from the overall performance.

The movable paper chute 14 may include guide wires 14B which are positioned on the upper and lower surfaces of the movable paper chute. In a preferred embodiment, three guide wires 14B may be positioned on the lower surface of the movable paper chute and three guide wires 14B may be positioned on the upper surface of the movable paper chute 14. The guide wires 14A reduce the friction between the photocopy and the movable paper chute and thus enhance the operation of the photocopier collator. In a second embodiment, the movable paper chute 14 may be lined with a surface of Teflon which reduces the friction between the photocopy and the movable paper chute so as to enhance the performance of the photocopier collator.

As illustrated in FIG. 1, a paper retainer 26 is provided adjacent the open side of the photocopier collator. The paper retainer ensures that the photocopies positioned within the bins 15–19 are retained therein during the operation of the photocopier collator. The paper retainer 26 is designed to pivot downwardly so as to enable an individual to remove the collated copies from the bins 15–19. Again, the paper retainer 26, although preferred, may be deleted without detracting from the overall performance.

FIG. 3 schematically illustrates the electrical circuit for controlling the solenoids 31 and 41. Initially, the switches 39 and 49 are moved to the closed position thereby actuating the photocopier collator of the present invention. The switch 39 connects the solenoid 31 to the electrostatic photocopy machine. As a photocopy is discharged from the electrostatic photocopy machine, an electrical pulse is received from the photocopy machine thereby actuating the solenoid 31 to enable the lowering of the follower 14A. Each time a pulse is received from the photocopy machine indicating that a photocopy is being discharged therefrom, the solenoid 31 is actuated to thereby move the follower 14A successively downwardly. Similarly, the switch 49 connects the solenoid 41 to the quantity control mechanism for the electrostatic photocopy machine. An individual operating the electrostatic photocopy machine would initially set the machine to process a predetermined number of copies. The switch 49 would connect the solenoid 41 to the mechanism for determining the quantity of copies desired. After the predetermined number of quantities are discharged from the photocopy machine, a pulse would be transmitted through the switch 49 to the solenoid 41 thereby actuating the solenoid 41 to return the movable paper chute 14 to its original position.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A chute return mechanism for a collator adapted for use with an electrostatic photocopy machine, said collator including a plurality of bins mounted within a housing, a movable chute operatively positioned to receive photocopies from a discharge slot of said electrostatic photocopy machine and divert said photocopies to each of said plurality of bins, said movable chute being selectively pivoted from an initial position, indexing means for selectively pivoting said movable chute including an electrical connection adapted to receive a first pulse from said electrostatic photocopy machine indicating that a photocopy has been discharged therefrom, said pulse actuating said indexing means for selectively pivoting said movable chute to lower said movable chute for diverting photocopies to each successive bin, the improvement comprising:

return means for returning said movable chute including an electrical connection adapted to receive a second pulse from said electrostatic photocopy machine indicating the completion of a predetermined number of copies, said second pulse actuating a drive means for imparting motion to a lever means for returning said chute to its initial position for diverting a photocopy to a first bin of said plurality of bins, said indexing means includes a cam latch having a tortuous path with flanges for guiding a follower element connected to the movable chute to lower said movable chute in response to said first pulse.

2. A chute return mechanism according to claim 1, wherein said lever means includes a pair of lever arms operatively connected to said drive means and in engagement with said follower element connected to said movable chute, actuation of said drive means imparting motion to said pair of lever arms to return said movable chute to its initial position.

3. A chute return mechanism according to claim 2, wherein said indexing means for selectively pivoting said movable chute includes a first solenoid actuated by said first pulse and operatively connected to said cam latch to lower said movable chute with each actuation of said first solenoid.

4. A chute return mechanism according to claim 3, wherein said movable chute and said pair of lever arms are mounted on an axis for movement relative to said plurality of bins.

5. A chute return mechanism according to claim 4, wherein said drive means includes a second solenoid actuated by said second pulse and operatively connected to a first lever arm of said pair of lever arms, a second lever arm of said pair of lever arms being in engagement with said follower element, actuation of said second solenoid imparting rotation to said first and second lever arms thereby imparting motion to said follower element to return said movable chute to its initial position.

6. A chute return mechanism according to claim 4, wherein said cam latch is pivotally mounted on said housing and is spring biased to a normally substantially vertical position.

7. A chute return mechanism according to claim 6, wherein said follower element connected to said movable chute projects through an arcuate slot in said housing, said arcuate slot and said tortuous path of said cam latch acting together to retain said follower and selectively lower said movable chute with each actuation of said first solenoid.

8. A chute return mechanism according to claim 7, wherein said movable chute is mounted on said axis on said housing and said arcuate slot defines an arc of a circle wherein the radius is defined as the distance between said follower and said axis of said movable chute.

9. A collator according to claim 1, wherein said movable chute includes guide wires positioned interiorly thereof to reduce the friction of photocopies received from said electrostatic photocopy machine.

10. A collator according to claim 1, wherein said movable chute includes a Teflon surface positioned interiorly thereof to reduce the friction of photocopies received from said electrostatic photocopy machine.

* * * * *